United States Patent [19]

Koike et al.

[11] Patent Number: 4,948,719

[45] Date of Patent: Aug. 14, 1990

[54] PHOTOGRAPHIC SUPPORT

[75] Inventors: Kazuyuki Koike; Tetsuro Fuchizawa, both of Shizuoka; Keisuke Shiba, Kanagawa, all of Japan

[73] Assignee: Fuji Photo Film Co., Ltd., Kanagawa, Japan

[21] Appl. No.: 179,925

[22] Filed: Apr. 11, 1988

[30] Foreign Application Priority Data

Apr. 9, 1987 [JP] Japan ..... 62-87636
Apr. 9, 1987 [JP] Japan ..... 62-87637

[51] Int. Cl.[5] ..... G03C 1/94

[52] U.S. Cl. ..... 430/524; 430/525; 430/526; 430/275; 430/272; 428/447; 428/450

[58] Field of Search ..... 430/272, 275, 276, 277, 430/278, 524, 525, 526, 523; 428/450, 447

[56] References Cited

U.S. PATENT DOCUMENTS

| | | | |
|---|---|---|---|
| 4,499,152 | 2/1985 | Green et al. | 428/450 |
| 4,640,868 | 2/1987 | Penn | 428/450 |
| 4,668,601 | 5/1987 | Kistner | 480/292 |
| 4,801,507 | 1/1989 | Estes et al. | 428/450 |
| 4,801,658 | 1/1989 | Furukama et al. | 430/450 |
| 4,851,327 | 7/1989 | Fuchizawa et al. | 430/503 |

*Primary Examiner*—Jack P. Brammer
*Attorney, Agent, or Firm*—Sughrue, Mion, Zinn, Macpeak & Seas

[57] ABSTRACT

A photographic support comprising a substrate having thereon a metal film layer having mirror reflective surface or secondary diffuse-reflective surface and an adhesive layer on the metal film layer, wherein the adhesive layer contains a copolymer composition of a diolefin and at least one other ethylenically unsaturated polymerizable monomer, or a silane coupling agent represented by formula (2-I) or (2-II):

(2-I)

(2-II)

wherein Y represents an organic functional group, R represents an alkylene group having 1 to 5 carbon atoms, R′ represents an alkoxy group having 1 to 4 carbon atoms, and n represents 2 or 3.

4 Claims, No Drawings

PHOTOGRAPHIC SUPPORT

FIELD OF THE INVENTION

The present invention relates to a photographic support providing excellent images and, more particularly, it relates to a photographic support which is not subject to delamination from a silver halide photosensitive layer, which permits development to occur without defects such as fogging or spotting, and which is capable of providing images with good reproducibility of hue, gradation, etc. and excellent sharpness.

BACKGROUND OF THE INVENTION

Photographic or recording media which are excellent in reproducibility of gradation and reproducibility of hue in the case of color photography and which provide excellent image sharpness can be obtained by using a photographic support having a mirror reflective surface or secondary diffuse-reflective surface as compared with the case of using other known types of photographic supports such as a transparent plate or film, e.g., of TAC, PET or polycarbonate, paper, synthetic paper, barayta paper of a white pigment-impregnated film or plate, or a metal plate such as an aluminum plate having an anodized surface. For instance, photographic supports having a mirror reflective surface or secondary diffuse-reflective surface are described in Japanese Patent Application (OPI) Nos. 210346/86, 24247/88, 24251/88, 24252/88, 24253/88, and 24255/88 (the term "OPI" as used herein means a "published unexamined Japanese patent application").

The term "mirror reflection" herein indicates a reflection on a smooth surface in accordance with the regular reflection law.

The term "secondary diffuse-reflection" herein indicates a reflection occurring on a smooth mirror surface but on which very small unevennesses are provided to form boundaries thereon.

Details of the reflection on the surface of substances are described in *Shikisai Kaqaku Handbook*, 5th edition, chapter 18, edited by Nippon Shikisai Gakkai and published by Tokyo Daigaku Shuppan-kai in 1985.

For providing the mirror reflective property or secondary diffuse-reflective property, a metal such as aluminum, silver, gold, copper, chromium, nickel and platinum or the alloys thereof is used generally, with aluminum being used preferably. Natural micas, scales of fishes or pearlescent inorganic matters may also be used to provide the support having a mirror reflective property or secondary diffuse-reflective property. However, if a metal less noble than metallic silver is used as the support for use in photographic or recording photosensitive material using a silver halide photographic emulsion, fogging or spotting tends to be generated in the course of the development. In view of the above, it has been known to employ an adhesive layer made of a thermoplastic resin between the support substrate and the photographic emulsion. However, when using the adhesive layer, delamination of the photographic emulsion layer or the like is liable to occur during development or during drying after the development. Further, there is difficulty in forming a thin adhesive layer, for example, from 0.1 to 5 μm of thickness using the thermoplastic resin. Further, when using the adhesive layer there is a risk of resulting degradation or unevenness in the mirror reflection or secondary diffuse-reflection.

SUMMARY OF THE INVENTION

The object of the present invention is to provide a photographic support free from defects such as fogging, spotting or delamination of the photosensitive layer during, before or after development, as well as to provide a photographic support which has excellent image preserving performance.

These and other objects will be apparent from the following description of the specification.

As a result of various studies, it has been found that the foregoing objects of the present invention can be attained by a photographic support comprising a substrate having thereon a metal film layer having mirror reflective surface or secondary diffuse-reflective surface and an adhesive layer on the metal film layer, wherein the adhesive layer contains a copolymerizable composition comprising a diolefin and at least one other ethylenically unsaturated polymerizable monomer. This photographic support will be referred to as the first aspect of the present invention.

It has also been found that the objects of the present invention can be attained by a photographic support comprising a substrate having thereon a metal film layer having mirror reflective surface or secondary diffuse-reflective surface and an adhesive layer on the metal film layer, wherein the adhesive layer contains a silane coupling agent represented by the following formula (2-I) or (2-II):

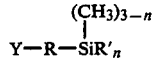

(2-I)

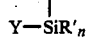

(2-II)

wherein Y represents an organic functional group, R represents an alkylene group having 1 to 5 carbon atoms, R′ represents an alkoxy group having 1 to 4 carbon atoms and n represents 2 or 3. This photographic support will be referred to as the second aspect of the present invention.

DETAILED DESCRIPTION OF THE INVENTION

Preferably, in the first aspect of the present invention, the adhesive layer contains at least one compound represented by formulae (1-I) to (1-XI), respectively, as monomer.

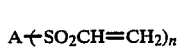

(1-I)

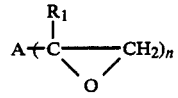

(1-II)

In formulae (1-I) and (1-II), A represents and n-valent organic residual group, n represents an integer of 2 to 10, and $R_1$ represents a hydrogen atom, a substituted or unsubstituted alkyl group, a substituted or unsubstituted aryl group, a substituted or unsubstituted aralkyl group, a substituted or unsubstituted alkenyl group, or a substituted or unsubstituted alkynyl group.

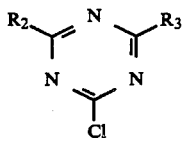

(1-III)

wherein $R_2$ and $R_3$, which may be the same or different, each represents a chlorine atom, an —OM group (in which M represents a hydrogen atom or a monovalent metal atom), a substituted or unsubstituted alkyl group, an alkoxy group, a substituted or unsubstituted amino group, or —$NHCOR_6$ (in which $R_6$ represents a hydrogen atom, an alkyl group, an aryl group or an alkylthio group).

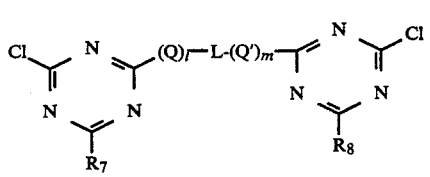

(1-IV)

wherein $R_7$ and $R_8$, which may be the same or different, each represents a chlorine atom, an —OM group, (in which M is the same meaning as in formula (III)), a substituted or unsubstituted alkyl group or an alkoxy group, Q, and Q', which may be the same or different, each represents —O—, —S— or —NH—, L represents an alkylene group or an arylene group, and l and m each represents 0 or 1.

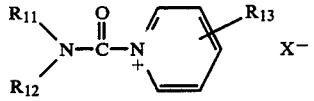

(1-V)

wherein $R_{11}$ and $R_{12}$, which may be the same or different, each represents a substituted or unsubstituted alkyl group, a substituted or unsubstituted aryl group, or a substituted or unsubstituted aralkyl group, and $R_{11}$ and $R_{12}$ may combine with each other to form a heterocyclic ring together with a nitrogen atom, $R_{13}$ represents a substituent such as a hydrogen atom, halogen atom, carbamoyl group, sulfo group, sulfoxy group, ureido group, alkoxy group, substituted or unsubstituted alkyl group or dialkyl-substituted amino group, and $X^-$ represents an anion which is unnecessary in the case of forming an inner salt.

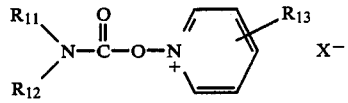

(1-VI)

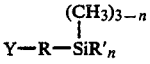

(2-I)

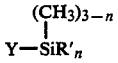

(2-II)

wherein $R_{11}$, $R_{12}$, $R_{13}$, and $X^-$ have the same meanings as those in formula (1-V).

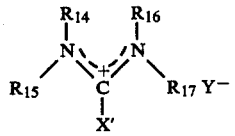

(1-VII)

wherein $R_{14}$, $R_{15}$, $R_{16}$ and $R_{17}$ each represents an alkyl, aralkyl, or aryl group which may be the same or different from each other Or may have a substituent, two of $R_{14}$, $R_{15}$, $R_{16}$ and $R_{17}$ may optionally combine to form a ring, $Y^-$ represents an anion which is not necessary in the case of forming an inner salt, and X' represents a group that can be split off when the compound represented by formula (1-VII) is reacted with a nucleophilic reagent.

(1-VIII)

wherein $R_{18}$ and $R_{19}$, which may be the same or different, each represents a substituted or unsubstituted alkyl group, a substituted or unsubstituted cycloalkyl group, a substituted or unsubstituted alkoxyalkyl group, or a substituted or unsubstituted aralkyl group, and $R_{19}$ can be a group represented by

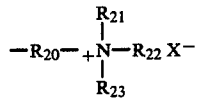

wherein $R_{20}$ represents a substituted or unsubstituted alkylene group, $R_{21}$ and $R_{22}$, which may be the same or different, each represents an alkyl group, $R_{21}$ and $R_{22}$ may combine to form a heterocyclic ring, $R_{23}$ represents a substituted or unsubstituted alkyl group, and $X^-$ represents an anion which is not required where $R_{23}$ forms an acid group to form an inner salt.

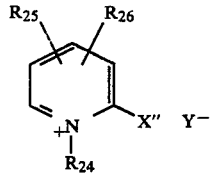

(1-IX)

wherein $R_{24}$ represents a substituted or unsubstituted alkyl group, a substituted or unsubstituted aryl group, or a substituted or unsubstituted aralkyl group, $R_{23}$ and $R_{26}$, which may be the same or different, each represents a substituent such as a hydrogen atom, a halogen atom, an acylamide group, a nitro group, a carbamoyl group, a ureido group, an alkoxy group, a substituted or unsubstituted alkyl group, an alkenyl group, an aryl group or an aralkyl group, $R_{25}$ and $R_{26}$ may combine to form a condensed ring, X'' represents a group that can be split off when the compound represented by formula (1-IX) is reacted with a nucleophilic reagent, and $Y^-$ represents an anion which is not necessary when an inner salt is formed.

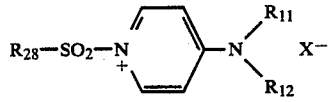

(1-X)

wherein $R_{11}$ and $R_{12}$ are the same meanings as those in formula (1-IV), $R_{28}$ represents a substituted or unsubstituted alkyl, aryl or aralkyl group, and $X^-$ represents an anion.

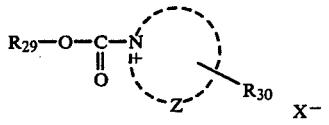

(1-XI)

wherein $R_{29}$ represents a substituted or unsubstituted alkyl, aryl or aralkyl group, Z represents a non-metal atom group required for completing a nitrogen-containing heterocyclic aromatic ring, $R_{30}$ represents a substituent such as a hydrogen atom, halogen atom, carbamoyl group, sulfo group, sulfoxy group, ureido group, alkoxy group, substituted or unsubstituted alkyl group, or dialkyl-substituted amino group, and $X^-$ represents an anion which is not required when an inner salt is formed.

In the first aspect of the present invention, the copolymer composition preferably is provided as an extremely thin film of from 0.1 to 5 μm thickness (the thinner the layer the better) and can be coated stably and uniformly in contact with the metal film layer at the surface of a support substrate. As a result, the metal film layer and the silver halide photosensitive layer can be chemically isolated from each other, not only during aging or photoexposure, but also during development or after image formation, and there is an excellent physically close contact between the layers. An outstandingly severe chemical masking property and physical close bondability are required for a metal film layer as compared with a general film base, for example, as compared to providing a subbing layer for a PET (polyethylene terephthalate) support base. Chemical masking and physical close bondability are required for a metal film layer because the metal film layer per se is subject to strong corrosion by the silver halide emulsion and is subject to dissolving by the developing solution.

The adhesive layer composed of the copolymer copolymer of a diolefin and an other ethylenically unsaturated polymerizable monomer.

The diolefins can include, for example, butadiene, 2-chloroprene, isoprene, neoprene, and 2,3-dimethylbutadiene.

The other ethylenically unsaturated polymerizable monomer used herein can include, for example, at least one of the following monomers: methyl acrylate, methyl methacrylate, ethyl acrylate, ethyl methacrylate, propyl acrylate, propyl methacrylate, butyl acrylate, butyl methacrylate, chloroethyl acrylate, chloroethyl methacrylate, hydroxyethyl acrylate, hydroxyethyl methacrylate, cyclohexyl acrylate, cyclohexyl methacrylate, 2-ethylhexyl acrylate, glycidyl acrylate, glycidyl methacrylate, phenyl acrylate, phenyl methacrylate, benzyl acrylate, benzyl methacrylate, phenylethyl acrylate, phenylethyl methacrylate, chloromethyl acrylate, chloromethyl methacrylate, 4-chlorobutyl acrylate, 4-chlorobutyl methacrylate, N,N-diethyl acrylate, N,N-diethyl methacrylate, sulfopropyl methacrylate, 2-ethoxyethyl acrylate, 2-ethoxyethyl methacrylate, acryl amide, methacryl amide, N-alkylacryl amide (alkyl including, for example, methyl, ethyl, propyl, butyl, amyl and hexyl), N,N-dialkylacryl amide (alkyl including, for example, methyl, ethyl, propyl, butyl and amyl, and two of the alkyl groups may be the same or different from each other), N-phenylacryl amide, N-benzylacryl amide, N-phenylethylacryl amide, N-methylolacryl amide, N-hydroxyethylacryl amide, N,N-dihydroxyethylacryl amide, N-oxycarbonylmethylacryl amide, N-oxycarbonylethylacryl amide, N-oxycarbonylphenylacryl amide, acrylonitrile, methacrylonitrile, α-chloroacrylonitrile, alkyl-α-chloroacrylate or alkyl-60 -chloromethacrylate (alkyl group include, for example, methyl, ethyl, propyl, butyl, benzyl and cyclohexyl), acrolein, methacrolein, vinyl isocyanate, isopropyl isocyanate, styrene, α-methylstyrene, p-chloromethylstyrene, m-chloromethylstyrene, α-chloromethylstyrene, vinyl methyl ether, vinyl ethyl ether, vinyl acetate, vinyl propionate, vinyl chloro acetate, vinyl trichloro acetate, acrylic acid, methacrylic acid, itaconic acid, itaconic acid anhydride, methyl itaconic acid monoester, ethyl itaconic acid monoester, maleic acid anhydride, alkyl maleic acid monoester (alkyl including, for example, methyl, ethyl, propyl, amyl, hexyl, pentyl, octyl and benzyl), alkyl fumaric acid monoester (alkyl including, for example, the same alkyls as those for the alkyl maleic acid monoester) and crotonic acid.

The emulsion copolymers of the diolefins and other ethylenically unsaturated polymerizable monomers are easy available as marketed products, and representatives of the available emulsion copolyemrs can include, for example, as follows.

For instance, those manufactured by Nippon Zeon Co., Ltd. can include Hicar-2570X5, Hicar-1551, Hicar-1561, Hicar-1571, Hicar-1562, Hicar-1577, Nipole 4840, Nipole LX-110, Hicar-LX204, Hicar-LX303, Hicar-LX407, Hicar-LX411, Hicar-LX415, Hicar-LX416, Hicar-2507 and Hicar-2518; those manufactured by Takeda Chemical Industries, Ltd. can include, for example, Crosrene SA-24, Crosrene NA-10, Crosrene NS-16, Crosrene 2M-30, Crosrene NA-11, Crosrene SA-22, Crosrene SA-23, Crosrene SA-24, Crosrene 2M-33, Crosrene 2M-33A, Crosrene 2M-36, Crosrene 2M-38 and Crosrene SK-50; those manufactured by Asahi Dow Co., Ltd. can include, for example, Dowlatex 810, SB latex #612, SB latex #632; those manufactured by Mitsui Toatsu Chemicals, Inc. can include, for example, Polylac AL-911, Polylac ML-508, Polylac-ML-520, Polylac-ML-501, Polylac-ML-707, Polylac-ML-505, Polylac-ML-577, Polylac-ML-264 and Polylac-SL-204; those manufactured by Sumitomo Nogatac Co., Ltd. can include, for example Nitrex 2616, Nogatex 2572E, Nogatex 2001, Nogatex J-9049, Nogatex 2714 and SN-304; those manufactured by Dainichiseika Color & Chemicals Mfg. Co., Ltd. can include, for example, Binder #811 and Binder LF-3; those manufactured by Nakamura Kagaku Co., Ltd. can include NK Binder SM-200R; those manufactured by Nippon Gas Kagaku Co., Ltd. can include, for example, Corporex #1001 and Corporex #1031; those manufactured by Kyoritsu Kagaku Sangyo Co., Ltd. can include, for example, Woolcement 3C and Woolcement 3CS; and those produced by manufactured by Meisei Kagaku Co., Ltd. can include, for example, Vortex GU, all of which may be used effectively.

The emulsion copolymers used in the present invention preferably contain from 10 to 90% by weight of diolefin. More preferred are those containing about from 0.5 to 30% by weight of the other ethylenically unsaturated polymerizable monomer having a hydroxyl group, a formyl group, an active vinyl group, an epoxy group, a methane sulfonic acid ester group, an active ester group, an isooxazole group, a carboxyl group, an amide group, an alkoxy group, an isocyanate group, an ethylene imino group or a group having at least one of these groups at the terminal end and having at least one reactive (active or easily reactive) functional group in the copolymer composition.

In the first aspect of the present invention, the copolymer composition may further be comprised of comonomers having at least one carboxylic acid or phosphoric acid group.

In a preferred embodiment according to the first aspect of the present invention, the copolymer composition preferably is a copolymer of (A) a butadiene monomer, (B) at least one monomer selected from itaconic acid, methacrylic acid and acrylic acid, and (C) at least one monomer selected from styrene, α-methyl styrene, methyl methacrylate and acrylonitrile, which contains from 10 to 90% by weight of the butadiene monomer (A) and from 0.2 to 20% by weight of the acid unit (B).

As the copolymer composition that can satisfy the foregoing properties and can be synthesized with ease at reduced cost stably, butadiene copolymers which have been put to practical use generally for the PET subbing layer are particularly preferred. In the butadiene copolymer used in the present invention, the flexibility copolymer used in the present invention, the flexibility of the support may be conditioned or a blocking phenomenon can be mitigated by mixing the ethylenically unsaturated monomer (C), such as styrene, α-methyl styrene, methyl methacrylate and acrylonitrile, with the butadiene monomer (A). This can also moderate the creasing or flexing property of the metal film layer.

In an especially preferred embodiment of the present invention, a copolymer is used in which from 0.2 to 20% by weight of an ethylenically unsaturated acid monomer is appropriately mixed. If the amount of acid is excessive, the hydrophilic property of the adhesive layer is increased and can degrade the masking property of the metal layer and the photosensitive layer making it difficult to prevent fogging or spotting. Further, if an acid monomer is not used, close bondability between the metal film layer and the adhesive layer can not be maintained. In the case of using a metal film layer, for example, aluminum, the surface thereof forms an oxide. However, in the preferred embodiment of the present invention, aluminum atoms or oxygen atoms combine by means of covalent bond to the carboxyl groups to provide a close bondability between the metal film layer and the adhesive layer.

In a preferred embodiment of the first aspect of the present invention a hardening agent is used together with the copolymer composition. The hardening agent in the preferred embodiment according to the present invention is similar to a hardening agent for hydrophilic colloid such as gelatin. The hardening agent can partially react with unsaturated bonds present in the copolymer composition or carboxyl groups present in the copolymer, or can be fixed in the copolymer composition due to the hydrophilic affinity thereby leaving active functional groups for the hardening. It is of course possible to use a copolymer composition obtained by synthesizing a copolymer with a monomer having active functional groups for the hardening. When a layer containing a hydrophilic colloid such as gelatin is employed as subbing layer or adhesive layer (for example, as described in the specification of Japanese Patent Application Nos. 168800/86 and 168801/86), a crosslinking reaction with the hydrophilic colloid, such as gelatin, takes place to improve the adhesion between the two layers. In view of the above, it is preferred not to use in the hydrophilic colloid layer the hardening agent for the hydrophilic colloidal layer or reduce the concentration of the active groups for the hardening of the subbing layer.

A more detailed explanation will now be made of the hardening agent used in the first aspect according to the present invention.

Hydrophilic colloids which can be used in the present invention as a subbing layer between the adhesive layer and the photosensitive emulsion layer can include, for example, proteins such as gelatin and gelatin derivatives, polyvinyl alcohol, polysaccharides such as cellulose derivative and starch, natural substance such as gum arabic, dextrin, pullulan, and synthetic polymeric substance such as polyvinyl alcohol, polyvinyl pyrrolidone and highly water soluble polyvinyl compound of acryl amide. Among them, proteins such as gelatin and gelatin derivatives and polyvinyl alcohol or the derivatives thereof are preferably used. Compounds having functional groups used for hardening hydrophilic colloids, particularly, gelatin are used as the hardening agent.

Specific examples of the hardening agent are those compounds having, an active vinyl group, an epoxy group, an ethylene imino group, a methane sulfonate group, an active ester group, a carbodiimide group, an active carboimide group, an active sulfoimide group, an isooxazole group, an isocyanate group, etc. Among them, those compounds having at least two groups of the above groups are particularly preferred.

Further, inorganic compounds such as chrome alum or chromium acetate can also be used as the hardening agent.

Referring specifically the hardening agent usable in the present invention can include, for example, divinylsulfone N,N'-ethylenebis(vinylsulfonyl acetamide), 1,3-bis(vinylsulfonyl)-2-propanol, methylenebismaleimido, 5- acetyl-1,3-diacryloyl-hexahydro-s-triazine, 1,3,5-triacryloyl-hexahydro-s-triazine, 1,3,5-trivinylsulfonyl-hexahydro-s-triazine, as well as like other active vinyl compounds as described in U.S. Pat. Nos. 3,635,718 and 3,232,763 and British Pat. No. 994,869; 2,4-dichloro-6-hydroxy-s-triazine sodium salt, 2,4-dichloro-6-methoxy-s-triazine, 2,4-dichloro-6-(4-sulfonailino)-s-triazine sodium salt, 2,4-dichloro-6-(2-sulfoethylamino)-s-triazine, N,N'-bis(2-chloroethylcarbamyl)piperazine, as well as similar other active halogen compounds as described in U.S. Pat. Nos. 3,288,775 and 2,732,303, and British Pat. Nos. 974,723 and 1,167,207; bis(2,3-epoxypropyl)methylpropyl ammonium-p-toluene sulfonate, 1,4-bis(2',3'-epoxypropyloxy)butane, 1,3,5-triglycidylisocyanurate, 1,3 diglycidyl-5-(γ-acetoxy-β-oxypropyl)isocyanurate, as well as similar other epoxy compounds as described in U.S. Pat. Nos. 2,725,294, 2,725,295 and 3,091,537; 2,4,6-triethylene-s-triazine, 1,6-hexamethylene-N,N'-bisethylene urea, bis-β-ethyleneiminoethylthio ether and similar other ethyleneimine compounds as described in U.S. Pat. Nos. 3,017,280 and 2,983,611; methane sulfonic acid ester compounds such as 1,2-di(methanesulfoneoxy)ethane, 1,4-di(methanesulfoneoxy)butane and 1,5-di(methanesulfoneoxy) pentane; carbodiimide compounds such as dicyclohexylcarbodiimide, 1-cyclohexyl-3-(3-trimethylaminopropyl)carbodiimide-p-toluene sulfonate, and 1-ethyl-3-(3-dimethylaminopropyl)carbodiimide hydrochloride; isooxazole compounds such as 2,5-dimethylisooxazole perchlorate, 2-ethyl-5-phenylisooxazole-3'-sulfonate and 5,5'-(paraphenylene)bisisooxazole; inorganic compounds such as chrome alum; chromium acetate and zirconium sulfate; dehydration condensation type peptide reagents such as N-carboethoxy-2-isopropoxy-1,2-dihydroquinoline and N-(1-morpholinocarboxy)-4-methylpyridinium chloride; active ester compound such as N,N'-adipoyldioxydisuccinimide; N,N'-terephthaloyldioxydisuccineimide; and isocyanates such as toluene-2,4-diisocyanate, 1,6-hexamethylenediisocyanate and other like isocyanates as described in U.S. Pat. No. 3,103,437.

There can also be used as the hardening agent those compounds which are described in *The Theory of the Photographic Process*, pages 56–60, edited by C. E. Kenneth Mees and T. H. James, published from The Macmillan Co., Ltd. (N.Y.) 1969 (fourth edition), Japanese Patent Publication Nos. 24259/73, 13563/74, 48860/81 and 24902/82 and Japanese Patent Application (OPI) No. 94025/79, those compounds which are described in Japanese Patent Publication Nos. 6151/72 and 114120/76, Japanese Patent Application (OPI) Nos. 109050/87, 222242/87, 245261/87, 295045/87 and 11118/74, Japanese Patent Publication Nos. 12853/81 and 32699/83, Japanese Patent Application (OPI) Nos. 38540/75, 93470/77, 43353/81 and 113929/83, as well as in U.S. Pat. No. 3,321,313.

In the preferred embodiment according to the first aspect of the present invention, it is preferred that the adhesive layer contains as gelatin hardening agent at least one compound selected from those containing a group consisting of active vinyl group, epoxy group, ethylene imino group, methane sulfonate group, active ester group, active carbodiimido group, active sulfoimido group, isooxazole group, or isocyanate group, as well as chrome alum and chromium acetate.

In the present invention, the compounds shown below are particularly useful as hardening agents:

$$A\text{-}(SO_2CH{=}CH_2)_n \qquad (1\text{-I})$$

(1-II)

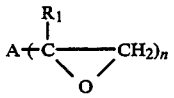

In formula (1-I) and (1-II), A represents an n-valent organic residual group, n represents an integer of 2 to 10 and R represents a hydrogen atom or a substituted or unsubstituted alkyl group, a substituted or unsubstituted aryl group, a substituted or unsubstituted aralkyl group, a substituted or unsubstituted alkenyl group or a substituted or unsubstituted alkynyl group.

Preferred organic residual groups represented by A can include, for example, a substituted or unsubstituted alkylene group (for example, methylene group, ethylene group, propylene group, $$-CH_2\overset{OH}{\overset{|}{C}}H-CH_2-, \text{ etc),}$$

an arylene group (for example, p-phenylene group, m-phenylene group,

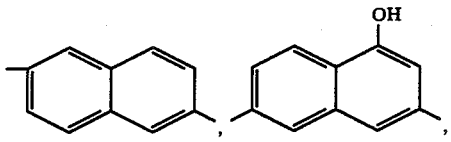

etc.), or a heterocyclic residual group, for example,

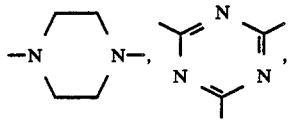

etc.), or $$\text{-}(CH_2)_i\text{-}CONH\text{-}(CH_2)_j\text{-}NHCO\text{-}(CH_2)_i\text{-},$$

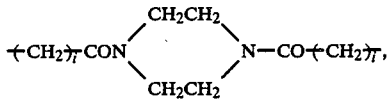

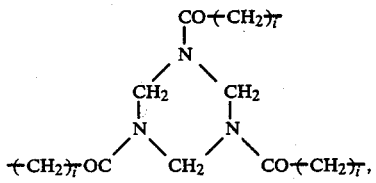

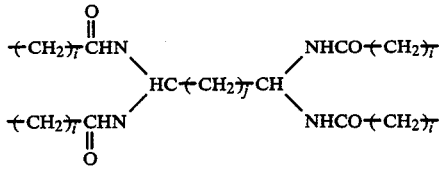

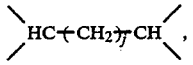

$$-CH_2-O\text{-}(CH_2)_i\text{-}OCH_2-,$$

$$\text{-}(CH_2)_i\text{-}O\text{-}(CH_2)_i\text{-},$$

$$\text{-}(CH_2)_i\text{-}S\text{-}(CH_2)_i\text{-},$$

$$\text{-}(CH_2)_i\text{-}SO_2\text{-}(CH_2)_i\text{-},$$

wherein i represents an integer of 1 to 12 and j represents an integer of 0 to 12.

Among them, substituted or unsubstituted alkylene groups, $$-CH_2O(CH_2)_iOCH_2-,$$

$$\text{-}(CH_2)_i\text{-}CONH(CH_2-)_j-NHCO-(CH_2)_i\text{-},$$

etc. are preferred.

R in formula (1-II) can include an alkyl group such as a methyl group, an ethyl group and a propyl group; an aryl group such as a phenyl group and a naphthyl group; an aralkyl group such as a benzyl group; an alkenyl group such as a vinyl group and a propenyl group, an alkynyl group such as an ethynyl group and an propynyl group. Substituents in this case may include, for example, a halogen atom, an alkyl group, a hydroxy group, an alkoxy group, an aryloxy group, an acyl group, an acylamino group, an alkylthio group, an arylthio group, a carbamoyl group and a sulfamoyl group.

Most preferably, R represents a hydrogen atom.

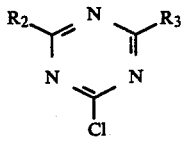

(1-III)

In formula (1-III), $R_2$ and $R_3$ each represents a chlorine atom, an —OM group (in which M represents a hydrogen atom or a monovalent metal atom), an alkyl group, an alkoxy group,

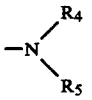

(in which $R_4$ and $R_5$ each represents a hydrogen atom, an alkyl group or an aryl group), and —$NHCOR_6$ (in which $R_6$ represents a hydrogen atom, an alkyl group, an aryl group or an alkylthio group), providing that $R_2$ and $R_3$ are not simultaneously chlorine atoms.

In formula (1-III), it is preferred that either one of the substituents represented by $R_2$ and $R_3$ is a chlorine atom. In a case where the substituent represented by $R_2$ and $R_3$ is —OM, M preferably represents a sodium or potassium atom. In the case where the substituents represented by $R_2$ and $R_3$ are an alkyl or alkoxy group, they are preferably a methyl group, an ethyl group, a butyl group, a methoxy group, an ethoxy group or a butoxy group. Further,

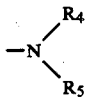

preferably is —$NH_2$, —$NHCH_3$, etc. and —$NHCOR_6$ preferably is —$NHCOCH_3$, etc.

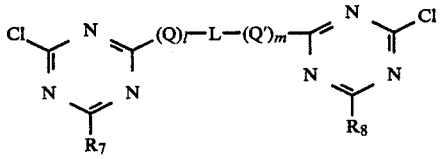

(1-IV)

In formula (1-IV), $R_7$ and $R_8$ each represents a chlorine atom, an —OM group (in which M represents a hydrogen atom or a monovalent metal atom), an alkyl group or an alkoxy group, Q and Q' each represents —O—, —S—, or —NH—, L represents an alkylene group, or an arylene group and l and m each represents 0 or 1.

In a case where the substituent represented by $R_7$ and $R_8$ in formula (1-IV) is an alkyl or alkoxy group, it is preferably, a methyl group, an ethyl group, a butyl group, a methoxy group, an ethoxy group or a butoxy group.

In a case where $R_7$ and $R_8$ is —OM, M is preferably a sodium or potassium atom. L preferably is —$CH_2$,

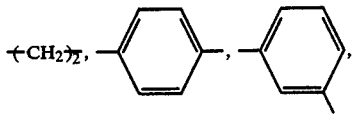

etc.

The hardening agents represented by formula (1-II) are described in Japanese Patent Publication Nos. 6151/72 and 33380/72, U.S. Pat. 3,645,743, and Japanese Patent Application (OPI) Nos. 19220/73, 78788/76, 60612/77, 128130/77, 130326/77 and 1043/81.

The hardening agent represented by formula (1-III) can be selected from those described in Japanese Patent Publication No. 33542/83 and Japanese Patent Application (OPI) No. 40244/82.

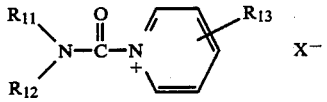

(1-V)

wherein $R_{11}$ and $R_{12}$, which may be the same or different, each represents an alkyl group having 1 to 10 carbon atoms (for example, a methyl group, an ethyl group and a 2-ethylhexyl group), an aryl group having 6 to 15 carbon atoms (for example, a phenyl group and a naphthyl group), or an aralkyl group having 7 to 15 carbon atoms (for example, a benzyl group and a phenethyl group). Further, $R_{11}$ and $R_{12}$ may preferably combine to each other to form a heterocyclic ring together with a nitrogen atom. Ring-forming examples can include a pyrrolidine ring, a piperazine ring, a morpholine ring, etc. R13 represents a substituent such as a hydrogen atom, halogen atom, carbamoyl group, sulfo group, sulfoxy group, ureido group, alkoxy group having 1 to 10 carbon atoms, alkyl group having 1 to 10 carbon atoms and dialkyl-substituted amino group having 2 to 20 carbon atoms In a case where $R_{13}$ is an alkoxy group, alkyl group, dialkylamino group or N-alkylcarbamoyl group, these groups may further be substituted and examples of such substituent can include, for example, a halogen atom, a carbamoyl group, a sulfo group, a sulfoxy group and a ureido group. X-represents an anion, which forms a counter ion to a N-carbamoyl pyridinium salt. In a case where a sulfo group or sulfoxy group is contained in the substituent of $R_{13}$, it may form an inner salt and X- may not be present. Preferred examples of anions can include, for example, halide ions, sulfate ions, sulfonate ions, $ClO_4^-$, $BF_4^-$ and $PF_6^-$.

The carbamoyl ammonium salt type hardening agent represented by formula (1-V) are specifically described in Japanese Patent Publication Nos. 12853/81 and 32699/83 and Japanese Patent Application (OPI) Nos. 51945/74, 59625/76 and 9641/86.

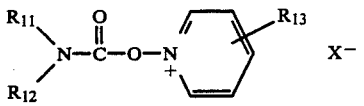

(1-VI)

The difinitions for $R_{11}$, $R_{12}$, $R_{13}$ and X— are the same as those for formula (1-V), and these compounds are specifically described in Bergium Patent No. 825726.

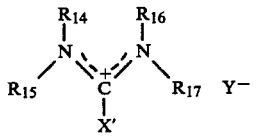

(1-VII)

$R_{14}$, $R_{15}$, $R_{16}$ and $R_{17}$ each represents an alkyl group having 1 to 20 carbon atoms (for example, a methyl group, an ethyl group, a butyl group, a 2-ethylhexyl group and a dodecyl group), an aralkyl group having 6 to 20 carbon atoms (for example, a benzyl group, a phenethyl group and a 3-pyridylmethyl group), or an aryl group having 5 to 20 carbon atoms (for example, a phenyl group, a naphthyl group and a pyridyl group), which may be the same or different from each other. Further, $R_{14}$, $R_{15}$, $R_{16}$ and $R_{17}$ may have substituents and such substituents can include, for example, a halogen atom, an alkoxy group having 1 to 20 carbon atoms, an aryloxy group having 6 to 20 carbon atoms and a N,N-disubstituted carbamoyl group.

It is also preferred that any two groups of $R_{14}$, $R_{15}$, $R_{16}$ and $R_{17}$ are combined to form a ring For instance, $R_{14}$ and $R_{15}$, $R_{16}$ and $R_{17}$ may combine to form a ring together with a nitrogen atom, for example, as in the dace of forming a pyrrolidine ring, a piperazine ring, a perhydroazepine ring and a morpholine ring. Further, $R_{14}$ and $R_{16}$ or $R_{15}$ and $R_{17}$ may combine to form a ring together with two nitrogen atoms and a carbon atom put therebetween as in the case of forming an imidazoline ring, a tetrahydropyrimidine ring and a tetrahydrodiazepine ring.

X' represents a group that can be split off when the compound represented by formula (1-VII) is reacted with a neucleophilic reagent and preferred examples thereof are a halogen atom, a sulfonyl oxy group, and a 1-pyridinium group. $Y^-$ represents an anion, preferably, a halide ion, a sulfonate ion, a sulfate ion, $ClO_4^-$, $BF_4^-$, $PF_6^-$, etc.

In a case where $Y^-$ represents the sulfonate ion, it may form an inner salt being joined with X, $R_{14}$, $R_{15}$, $R_{16}$ and $R_{17}$.

The amidinium salt type hardening agent represented by formula (1-VII) is specifically described in Japanese Patent Application (OPI) No. 225148/85.

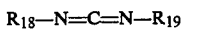

$R_{18}$—N=C=N—$R_{19}$ (1-VIII)

wherein $R_{18}$ represents an alkyl group having 1 to 10 carbon atoms (for example, a methyl group, an ethyl group, and a 2-ethylhexyl group), a cycloalkyl group having 5 to 8 carbon atoms (for example, a cyclohexyl group), an alkoxyalkyl group having 3 to 10 carbon atoms (for example, a methoxyethyl group) or an aralkyl group having 7 to 15 carbon atoms (for example, a benzyl group and a phenethyl group). In addition to the groups defined for $R_{18}$, $R_{19}$ preferably represents those groups represented by:

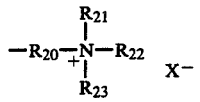

wherein $R_{20}$ represents an alkylene group having 2 to 4 carbon atoms (for example, an ethylene group, a propylene group and a trimethylene group), $R_{21}$ and $R_{22}$ each represents an alkyl group having 1 to 6 carbon atoms (for example, a methyl group, and an ethyl group) which may be the same or different from each other. Further, $R_{21}$ and $R_{22}$ may preferably combine to form a heterocyclic ring together with a nitrogen atom (for example, a pyrrolidine ring, a piperazine ring and a morpholine ring). $R_{23}$ represents an alkyl group having 1 to 6 carbon atoms (for example, a methyl group, an ethyl group and a butyl group), which may preferably be substituted. Preferred examples of the substituent is a substituted or unsubstituted carbamoyl group or a sulfo group. X— represents an anion which is preferably a halide ion, a sulfonate ion, a sulfate ion, $ClO_4^-$, $BF_4^-$, $PF_6^-$, etc. Further, if $R_{23}$ is substituted with a sulfo group, it may form an inner salt in which X— may not be present.

The carbodiimide type hardening agents of formula (1-VIII) are particularly described in Japanese Patent Application (OPI) Nos. 126125/76 and 48311/77

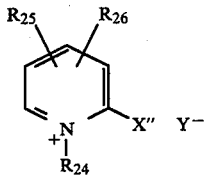

(I-IX)

wherein $R_{24}$ represents an alkyl group having 1 to 10 carbon atoms (for example, a methyl group, an ethyl group and a butyl group), an aryl group having 6 to 15 carbon atoms (for example, a phenyl group and a naphthyl group), an aralkyl group having 7 to 15 carbon atoms (for example, a benzyl group and a phenethyl group). These groups may or may not be substituted and examples of the substituent are a carbamoyl group, a sulfamoyl group, a sulfo group, etc. $R_{25}$ and $R_{26}$, which may be the same or different, each represents those substituents such as a hydrogen atom, a halogen atom, an acyl amide group, a nitro group, a carbamoyl group, a ureido group, an alkoxy group, an alkyl group, an alkenyl group, an aryl group and an aralkyl group. It is also preferred that $R_{25}$ and $R_{26}$ may combine to form a condensed ring.

X'' in formula (1-IX) represents a group that can be split off when the compound represented by formula (1-IX) reacts with a nucleophilic reagent and preferred examples thereof are a halogen atom, a sulfonyloxy group or a group represented by

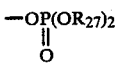

(in which $R_{27}$ represents an alkyl group or an aryl group). In a case where X'' represents a sulfonyloxy group, it is also preferred that X'' and $R_{24}$ are joined.

Y— in formula (1-IX) represents an anion which is preferably a halide ion, a sulfonate ion, a sulfate ion, $ClO_4^-$, $BF_4^-$, $PF_6^-$, etc. In a case where $R_{24}$ is substituted with a sulfo group, it may form an inner salt and Y— may not be present.

The pyridinium salt type hardening agents of formula (1-IX) are specifically disclosed in Japanese Patent Publication No. 50699/83 and Japanese Patent Application (OPI) Nos. 44140/82 and 46538/82.

(1-X)

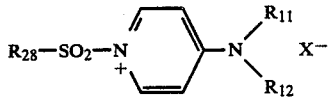

wherein the definitions $R_{11}$ and $R_{12}$ are the same as those for $R_{11}$ and $R_{12}$ in formula (1-V), $R_{28}$ represents an alkyl group with 1 to 10 carbon atoms (for example, a methyl group, an ethyl group, and a butyl group), an aryl group having 6 to 15 carbon atoms (for example, a phenyl group and a naphthyl group) or an aralkyl group having 7 to 15 carbon atoms (for example, a benzyl group and a phenethyl group), and X— represents an anion which preferably is a halide ion, a sulfonate ion, a sulfate ion, $ClO_4^-$, $BF_4^-$, $PF_6^-$.

The pyridinium salt type hardening agents represented by formula (1-X) are specifically disclosed in Japanese Patent Application (OPI) No. 54427/77.

(1-XI)

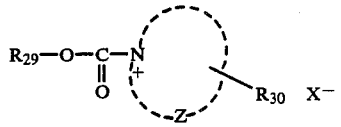

wherein $R_{29}$ represents an alkyl group having 1 to 10 carbon atoms (for example, a methyl group, an ethyl group, a 2-ethylhexyl group), an aryl group having 6 to 15 carbon atoms (for example, a phenyl group and a naphthyl group), or an aralkyl group having 7 to 15 carbon atoms (for example, a benzyl group and a phenethyl group) which may be substituted or not substituted. Examples of the substituent can include a halogen atom, a carbamoyl group, a sulfo group, a sulfoxy group, a ureido group, an alkoxy group having 1 to 10 carbon atoms, an alkyl group having 1 to 10 carbon atoms, and a dialkyl-substituted amino group having 2 to 20 carbon atoms.

Z represents a non-metal atomic group required for completing a nitrogen-containing heterocyclic aromatic ring and preferred examples can include, for example, a pyridine ring, a pyrimidine ring, a pyrazole ring, an imidazole ring, an oxazole ring, and a benzo condensed ring thereof.

$R_{30}$ in formula (1-XI) represents a hydrogen atom, a halogen atom, a carbamoyl group, a sulfo group, a sulfoxy group, a ureido group, an alkoxy group having 1 to 10 carbon atoms, an alkyl group having 1 to 10 carbon atoms, a dialkyl-substituted amino group having 2 to 20 carbon atoms. In a case where $R_{30}$ is an alkoxy group, an alkyl group, a dialkyl amino group or an N-alkyl carbamoyl group, these groups may further be substituted and examples of such substituents are a halogen atom, a carbamoyl group, a sulfo group, a sulfoxy group and a ureido group.

X— in formula (1-XI) represents an anion. When a sulfo group or sulfoxy group is contained in $R_{29}$ and $R_{30}$ or the substituents thereof, it may form an inner salt and X— may not be present. Preferred examples for the anion can include, for example a halide ion, a sulfate ion, a sulfonate ion, $ClO_4^-$, $VF_4^-$, $PF_6^-$.

Several specific examples of the compounds represented by formula (1-I) are shown below:

$$CH_2{=}CH{-}SO_2CH_2SO_2CH{=}CH_2 \quad (1)$$

$$CH_2{=}CH{-}SO_2{-}CH_2{-}\underset{\underset{OH}{|}}{CH}{-}CH_2SO_2{-}CH{=}CH_2 \quad (2)$$

$$CH_2{=}CHSO_2CH_2CONH{-}(CH_2)_2{-}NHCOCH_2SO_2CH{=}CH_2 \quad (3)$$

Specific examples of the compounds represented by formula (1-II) are shown below.

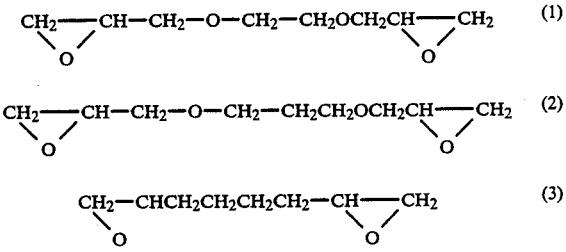

Specific examples of the compounds represented by formula (1-III) are shown below.

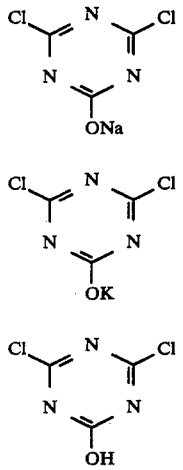

Specific examples of the compounds represented by formula (1-IV) are shown below.

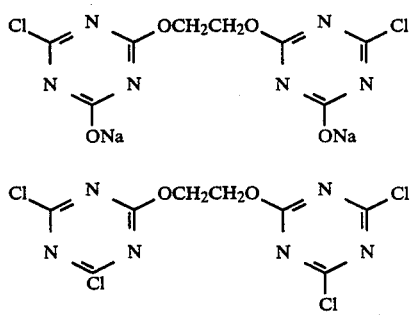

-continued (3)

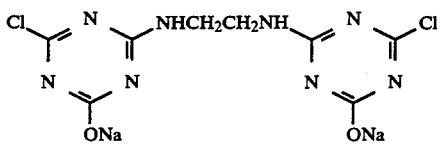

Specific examples of the compounds represented by formula (1-V) are shown below.

(1)

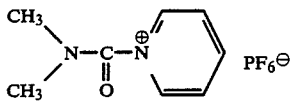

(2)

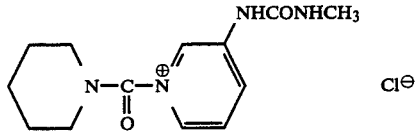

(3)

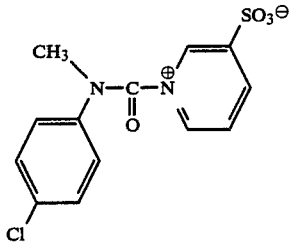

Specific examples of the compounds represented by formula (1-VI) are shown below.

(1)

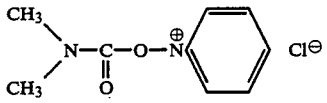

(2)

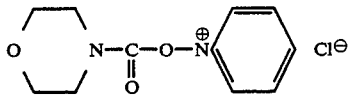

(3)

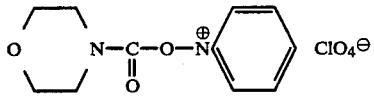

Specific examples of the compounds represented by formula (1-VII) are shown below.

(1)

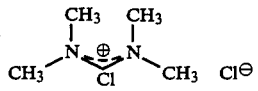

(2)

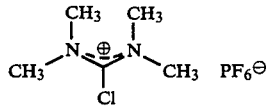

(3)

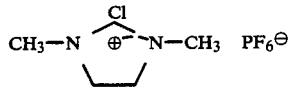

Specific examples of the compounds represented by formula (1-VIII) are shown below.

(1)

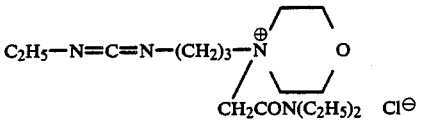

(2)

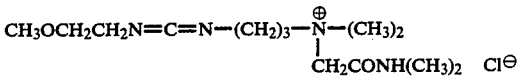

(3)

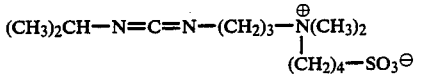

Specific examples of the compounds represented by formula (1-IX) are shown below.

(1)

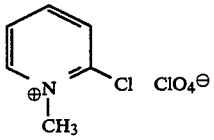

(2)

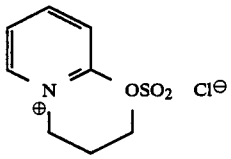

(3)

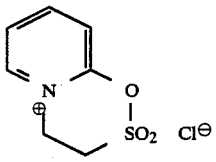

Specific examples of the compounds represented by formula (1-X) are shown below.

(1)

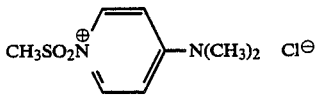

(2)

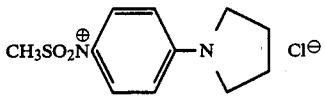

(3)

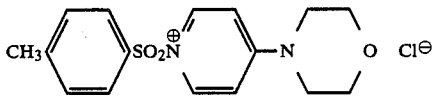

Specific examples of the compounds represented by formula (1-XI) are shown below.

(1)

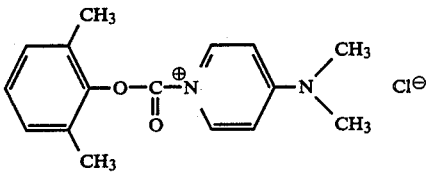

(2)

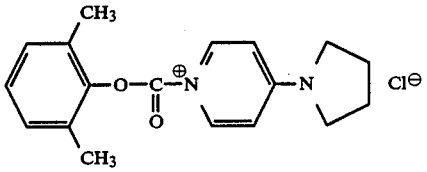

(3)

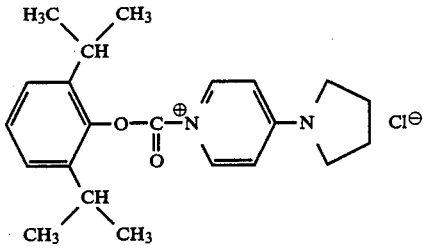

The adhesive layer containing the copolymer composition according to the present invention is greatly different from that of the conventional photographic support in that it is disposed on the upper surface of a metal film layer having the mirror reflecting properties or secondary diffuse-reflecting properties and it may be coated by using the methods as shown in Japanese Patent Application (OPI) Nos. 114120/76, 94025/79 and 11118/74.

When coating and drying the adhesive layer containing the copolymer composition (in the form of an aqueous latex) according to the present invention to the upper surface of the metal film layer, the bonding between the metal film layer surface and the adhesive layer becomes stronger as the drying temperature is higher. The drying temperature is not lower than 100° C. and, preferably, not lower than 140° C.

Turning now to the second aspect of the present invention where a silane coupling agent is employed, explanation will now be made specifically to preferred embodiments in accordance with the present invention.

In formula (2-I) and (2-II), preferred examples for the organic functional group, Y, are a vinyl group, a methacryl group, an epoxy group, an amino group and a mercapto group.

Specific examples of the silane coupling agent used in second aspect of the present invention include, for example, vinyltrichloro silane, vinyltris(β-methoxyethoxy)silane, vinyltriethoxy silane, vinyltrimethoxy silane, γ-methacryloxypropyltrimethoxy silane, β-(3,4-epoxycyclohexyl)ethyltrimethoxy silane, γ-glycidoxypropyltrimethoxy silane, γ-glycidoxypropylmethyldiethoxy silane, N-β(aminoethyl)γ-aminopropyltrimethoxy silane, N-β(aminoethyl)γ-aminopropylmethyldimethoxy silane, γ-trimethoxy silane, γ-mercaptopropyltrimethoxysilane, γ-chloropropyltrimethoxy silane.

It is preferred that the silane coupling agent is used by hydrolyzing alkoxy groups into silanol groups before coating to the metal layer surface since the bonding between the silane coupling agent and the metal film layer surface is improved. It is preferred that not less than 50% of the alkoxy groups are hydrolyzed.

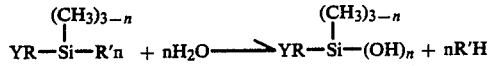

It is effective to apply a pre-treatment such as corona discharge, glow discharge and flame treatment after coating and drying the silane coupling agent for making the adhesion with the silver halide emulsion stronger. Further, a gelatin subbing layer may be applied on the silane adhesive layers prior to the coating of the silver halide emulsion.

The silane coupling agent used in the second aspect of the present invention preferably is coated uniformly as possible as a thin film of from 0.01 to 5 μm thickness on the surface of the metal film layer on the support substrate. If the thickness is less than 0.01 μm, poor adhesion result between the metal film layer and the silver halide photosensitive layer, whereas it is not economically advantageous and reproducibility in the hue, gradation, etc. is reduced if the thickness is more than 5 μm.

Further, the adhesive layer in the second aspect according to the present invention is quite different from that of the conventional photographic support in that it is disposed on the upper surface of the metal film layer having the mirror reflecting properties or secondary diffuse-reflecting properties and it may be coated by using the methods as shown in Japanese Patent Application (OPI) Nos. 114120/76, 94025/79 and 11118/74. Specifically, it can be coated, for example, by means of dip coating, air knife coating, curtain coating, roller coating, doctor coating, wire bar coating, slide coating and gravure coating.

In both the first and second aspects of the present invention, metals used for the metal film layer are, for example, those described on pages 174 to 184 of F. Benford et al., *J. Opt. Soc. Amer.*, 32 (1942) such as silver, aluminum, gold, copper, chromium/nickel alloy, platinum and alloys of them, e.g. aluminum/magnesium alloy, aluminum/copper alloy, aluminum/antimony alloy and brass. Preferably, aluminum or alloys thereof are used as the metals.

In both the first and second aspects of the present invention, the support having the surface of mirror reflecting properties or secondary diffuse-reflecting properties according to the present invention can be obtained by providing, on a support substrate, a thin layer of a material which provides a mirror reflection if the surface is sufficiently smooth. For instance, those methods as described in Japanese Patent Application (OPI) Nos. 210346/86 and 24247/88, or Japanese Patent Application Nos. 168800/86 and 249873/86 are used. Preferred metals are, for example, those metals as described in *J. Opt. Soc, Amer.*, vol. 32, pages 174 to 184, by F. Benford, et al, (1942), for example silver, aluminum, gold, copper, chromium, nickel and platinum or alloys thereof, for example, aluminum/magnesium, brass, etc. Further, it is possible to use a layer filled with the powder of the metal described above and even powder of inorganic substance such as of natural mica and scale providing mirror reflective property.

The substrate for the support may be those employed in the past, for example, plastic film, paper, RC paper, synthetic paper, metal plate, etc., as well as polymer or copolymer plates which exhibit excellent dimensional stability such as polycarbonate, polystyrene, polyacrylate, polymethacrylate and PET. Particularly preferred are paper or RC paper. The support according to the present invention can be obtained easily and at a reduced cost by using a low density polyethylene together with the polyethylene layer of RC paper and laminating thereto a previously prepared aluminum foil. For use as a disc-like recording medium as described in Japanese Patent Application No. 249873/86, polycarbonate, polystyrene, polyimide resin or ceramic material excellent in dimensional stability and physical strength are particularly useful as substrates.

The support according to the present invention can be used generally as a photographic reflection support. It is possible to provide, on a support, a silver halide emulsion layer for black and white print paper by way of an subbing layer and providing a protective layer further over the silver halide emulsion layer as required. Further, it is also possible to prepare photosensitive material for color print paper by using two or more layers of photosensitive silver halide emulsions having different spectral sensitivity as used in ordinary color print paper and containing different color couplers respectively. It is also possible to prepare color reversal photosensitive material, direct positive type color print paper, or direct positive type color copying material using light fogging method. Furthermore, it is also possible to prepare a silver dye bleach (SDB) type printing photosensitive material by providing, on the support, red sensitive, green sensitive and blue sensitive silver halide emulsion layers containing silver halide grains of different spectral sensitivity and dyes used for silver dye bleach method (SDB method). Furthermore, the supports of the present inventions can be used to prepare a reflection type disc plate, disc film or recording material using silver halide. More specifically, the supports of the present invention can be employed generally to prepare photosensitive materials as described in Japanese Patent Application (OPI) Nos. 4251/88, 24252/88, 24253/88 and 24255/88, and Japanese Patent Application Nos. 249873/86, 259794/86 and 275572/86.

A mordant layer may be provided on the support according to the present invention for use as material for forming a color image by diffusing and transferring a color development releasing type dye. It is also possible to add a physical developing nuclei to the subbing layer on the support according to the present invention for use as material forming silver diffused transfer type silver images. Further, it is also possible to provide on a support substrate, an adsorption layer (ADL) for development suppressing or silver removal suppressing material, which comprises, for example, iodine ions, bromine ions, heterocyclic compounds having mercapto groups and heterocyclic compounds capable of forming imino silver as described in Japanese Patent Publication No. 3737/84 and Japanese Patent Application (OPI) No. 65230/75.

Furthermore, the photographic support according to the present invention can also be applied to thermal developing photosensitive material and/or dye fixing material (image receiving material) as described in U.S. Patent No. 4,500,626, Japanese Patent Application (OPI) Nos. 133449/85, 218443/84 and 238056/86, etc.

The present invention will be explained referring to examples but it should be noted that the invention is no way restricted only to such examples.

EXAMPLE 1

Metal aluminum was subjected to coarse rolling. Then two metal aluminum sheets were rolled in lamination successively between two above and below adjacent rolling rollers to obtain an aluminum foil of about 10 μm thickness which was then annealed. This aluminum foil had a secondary diffuse-reflective surface.

Six emulsion polymer compositions were prepared by the emulsion polymerization of the monomers of the composition shown in the following table. Each emulsion polymer composition was used as an adhesive layer on the metal reflective surface of an aluminum foil prepared as above. Thus, each emulsion polymer composition was coated as an adhesive layer (primer coating) on the surface having the secondary diffuse-reflective property of the soft aluminum foil of 10 μm thickness.

| | | Composition of Adhesive Layer (wt %) | | | | | |
|---|---|---|---|---|---|---|---|
| | | 1 | 2 | 3 | 4 | 5 | 6 |
| Copolymerizable Monomer: | Butadiene | 48 | 48 | 33 | 33 | 67 | 67 |
| | Styrene | 47 | 47 | 63 | 63 | — | — |
| | Acrylonitrile | — | — | — | — | 31 | 31 |
| | Acrylic acid | — | — | 4 | 4 | — | — |
| | Itaconic acid | 5 | 5 | — | — | — | — |
| | Methacrylic acid | — | — | — | — | 2 | 2 |
| Additive: | 2,4-dichloro-6-hydroxy 1,3,5-triazine sodium salt | | | 2% | — | | |
| | 2,4,6-triethylene-imino-1,3,5-triazine | 2% | — | | | | |
| | Hexahydro-1,3,5-tri-acryloyl-s-triazine | | | | | 2% | |

*The additive percent means the weight percent of additive based on the total weight of the copolymerizable monomer The adhesive layer was coated in an amount of 0.5 g/m$^2$, dry weight, and it was dried at 140° C. for 10 min. Gelatin was coated thereover as a subbing in an amount of 0.2 g/m$_2$, dry weight, and dried at 140° C. for 10 min. Butyl titanate was coated in an amount of 0.1 g/m$^2$ on the aluminum surface opposite to the adhesive layer.

The surface of the aluminum foil coated with the butyl titanate was laminated to a base paper of 150 g/m$^2$ basis weight by means of low density polyethylene melted at 250 to 350 ° C. High density polyethylene then was laminated onto the base paper by melting at the surface opposite to the aluminum lamination at 250 to 350 ° C.

A silver halide emulsion was coated according to Example 4 of Japanese Patent Application (OPI) No. 24247/88 onto the undercoated aluminum surface of the support, completed as described above, to obtain a photographic color print paper.

A silver halide emulsion (1) for use in the present invention was prepared as below:

Solution 1

| | |
|---|---|
| $H_2O$ | 1000 cc |
| NaCl | 5.5 g |
| Gelatin | 32 g |

Solution 2

| | |
|---|---|
| Sulfuric acid (1N) | 24 cc |

Solution 3

The following silver halide solvent (1%) 3 cc

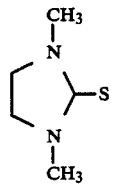

Solution 4

| | |
|---|---|
| KBr | 15.66 g |
| NaCl | 3.30 g |
| $H_2O$ to make: | 200 cc |

Solution 5

| | |
|---|---|
| $AgNO_3$ | 32 g |
| $H_2O$ to make: | 200 cc |

Solution 6

| | |
|---|---|
| KBr | 62.72 g |
| NaCl | 13.22 g |
| $H_2IrCl_6$ (0.001%) | 4.54 cc |
| $H_2O$ to make: | 600 cc |

Solution 7

| | |
|---|---|
| $AgNO_3$ | 128 g |
| $H_2O$ to make: | 600 cc |

(Solution 1) was heated to 56° C., to which (Solution 2 and (Solution 3) were added. Then, (Solution 4) and (Solution 5)were added simultaneously for 30 min. After a 10 min. wait, (Solution 6) and (Solution 7) were added simultaneously for 20 min. After a 5 min. wait, the temperature was lowered and silver was removed. Water and dispersible gelatin thus were added and pH was adjusted to 6.2 to obtain a monodispersed cubic silver bromide salt emulsion of average grain size of 0.45 μm, variation coefficient (value obtained by dividing the standard deviation with the average grain size: s/d) of 0.08 and 70 mol% of silver bromide content. Sodium thiosulfate was added to the emulsion and chemical sensitization was applied.

Then, silver halide emulsions (2), (3) and (4) having different silver chloride contents were prepared in the same manner by varying the amount of KBr and NaCl in (Solution 4) and (Solution 6) and by varying the addition time of (Solution 4) and (Solution 5) as shown in Table 1.

TABLE 1

| Emulsion | Solution 4 KBr (g) | Solution 4 NaCl (g) | Solution 6 KBr (g) | Solution 6 NaCl (g) | Addition time of (Solution 4) and (Solution 5) (min) |
|---|---|---|---|---|---|
| (2) | 6.71 | 7.70 | 26.88 | 30.84 | 12 |
| (3) | 3.36 | 9.35 | 13.44 | 37.44 | 10 |
| (4) | 0.22 | 10.89 | 0.90 | 43.61 | 8 |

Average grain size, variation coefficient and halogen composition of the silver halide emulsions (1) to (4) are shown in Table 2.

TABLE 2

| Emulsion | Average Grain Size (μm) | Coefficient Variation | Halogen composition Br (%) | Halogen composition Cl (%) |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 1 | 99 |

First layer to seventh layer shown in Table 3 were laminated on each of the supports in that order to obtain color photosensitive materials.

First Layer

Blue-sensitive sensitizing dye (a) was added to the silver halide emulsion (4) in an amount of $7.0\times10^{-4}$ mol per mol of Ag to provide spectral sensitization. Further, yellow coupler (d) and color image stabilizer (e) were mixed, dissolved and dispersed with solvent (f) and added in a predetermined amount as shown in Table 3. They were coated as the first layer.

Third Layer

A green-sensitive sensitizing dye (b) was added to the silver halide emulsion (3) in an amount of $4.0\times10^{-4}$ mol per mol of Ag to provide spectral sensitization. Further, magenta coupler (h) and color image stabilizer (i) were mixed, dissolved and dispersed with solvent (j) and added in a predetermined amount as shown in Table 3. They were coated as the third layer.

Fifth Layer

A red-sensitive sensitizing dye (c) was added to the silver halide emulsion (2) in an amount of $1.0\times10^{-4}$ mol per mol of Ag to provide spectral sensitization. Further, cyan coupler (n) and color image stabilizer (o) were mixed, dissolved and dispersed with solvent (f) and added in a predetermined amount as shown in Table 3. They were coated as the fifth layer.

Coating solutions for the second layer, fourth layer, sixth layer and seventh layer were produced in a similar manner.

The first layer, the second layer, the third layer, the fourth layer, the fifth layer, the sixth layer and the seventh layer were coated on the adhesive layer of the support in predetermined amounts as shown in Table 3 by a slide coating method to obtain samples No. 1 to No. 6, as well as the comparative sample shown in Comparative Example 1. (See Table 4).

The samples as described above were subjected to image exposure for enlarged print image through sensitometry gradation exposure or negative film by using a 2854° K light source and by way of blue, green and red color separation filter, etc.

Then, a photographic image was obtained by way of the respective steps of color development, bleach-fixing and rinsing.

| | | |
|---|---|---|
| Development | 35° C. | 45 sec |
| Bleach-fixing | 35° C. | 45 sec |
| Rinsing | 28–35° C. | 1 min 30 sec |

The processing solutions used in the above-described steps had the following compositions.

Color Developing Solution

| | |
|---|---|
| Water | 800 cc |
| Diethylenetriamine pentaacetic acid | 1.0 g |
| Sodium sulfite | 0.2 g |
| N,N-diethylhydroxylamine | 4.2 g |
| Potassium bromide | 0.6 g |
| Sodium chloride | 1.5 g |
| Triethanolamine | 8.0 g |
| Potassium carbonate | 30 g |
| N-ethyl-N-(β-methane sulfonamide ethylamino)-3-methyl-4-amino aniline sulfate | 4.5 g |
| 4,4'-diaminostylbene type fluorescent whitening agent (Whitex 4, manufactured by Sumitomo Chemical Company, Limited.) | 2.0 g |
| Water to make | 1000 cc |
| Adjusted with KOH to pH 10.25 | |

Bleach-Fixing Solution

| | |
|---|---|
| Ammonium thiosulfate (54 wt %) | 150 ml |
| $Na_2SO_3$ | 15 g |
| $NH_4[Fe(III)(EDTA)]$ | 55 g |
| EDTA.2Na | 4 g |
| Glacial acetic acid | 8.61 g |
| Water to make: | 1000 ml (pH 5.4) |

Rinsing Solution

| | |
|---|---|
| $EDTA.2Na.2H_2O$ | 0.4 g |
| Water to make: | 1000 ml (pH 5.4) |

Upon visually observing the photographic images obtained by employing the supports of the present invention, the saturation of the magenta and yellow images were extremely excellent and the sharpness was surprisingly improved as compared with the comparative sample. A comparative sample produced in Comparative Example 1 described below caused delamination and an image could not be observed.

TABLE 3

| Layer | Main Composition | Amount used |
|---|---|---|
| Seventh layer (protective layer) | Gelatin | 1.33 g/m² |
| | Acryl modified copolymer of a PVA (modification degree: 17%) | 0.17 g/m² |
| Sixth layer (Ultra Violet absorbing layer) | Gelatin | 0.54 g/m² |
| | UV absorber (k) | 0.21 g/m² |
| | Solvent (m) | 0.09 cc/m² |
| Fifth layer (Red-sensitive layer) | Silver halide emulsion (2) Silver: | 0.22 g/m² |
| | Gelatin | 0.90 g/m² |
| | Cyan coupler (n) | 0.36 g/m² |
| | Color image stabilizer (o) | 0.17 g/m² |
| | Solvent (f) | 0.22 cc/m² |
| | Red-sensitive sensitizing dye (c) | |
| Fourth layer (Ultra Violet absorbing layer) | Gelatin | 1.60 g/m² |
| | UV absorber (k) | 0.62 g/m² |
| | Color stain preventing agent (l) | 0.05 g/m² |
| | Solvent (m) | 0.26 cc/m² |
| Third layer (Ultra Violet absorbing layer) | Silver halide emulsion (3) Silver: | 0.15 g/m² |
| | Gelatin | 1.80 g/m² |
| | Magenta coupler (h) | 0.38 g/m² |
| | Color image stabilizer (i) | 0.16 g/m² |
| | Solvent (j) | 0.38 cc/m² |
| | Green-sensitive sensitizing dye (b) | |
| Second layer (Color stain preventing layer) | Gelatin | 0.99 g/m² |
| | Color stain preventing agent (g) | 0.08 g/m² |
| | Silver halide emulsion (4) Silver: | 0.26 g/m² |
| First layer (Blue-sensitive layer) | Gelatin | 1.83 g/m² |
| | Yellow coupler (d) | 0.91 g/m² |
| | Color image stabilizer (e) | 0.19 g/m² |
| | Solvent (f) | 0.36 cc/m² |
| | Blue-sensitive sensitizing dye (a) | |

(a) Blue-sensitive sensitizing dye

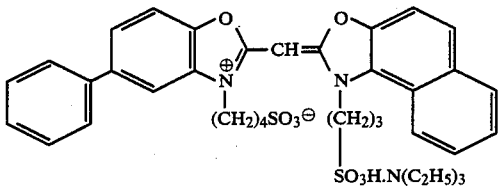

(b) Green-sensitive sensitizing dye

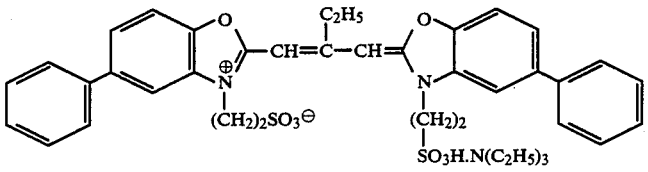

(c) Red-sensitive sensitizing dye

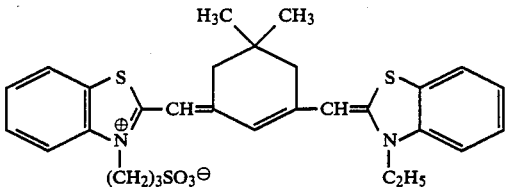

(d) Yellow coupler
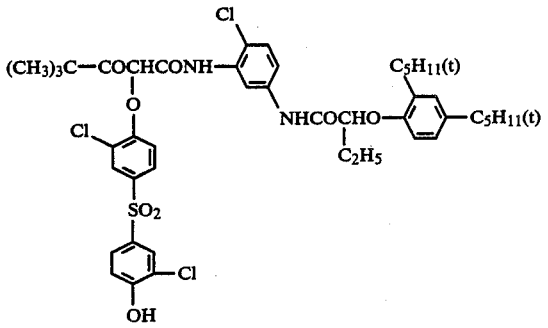
(e) Color image stabilizer
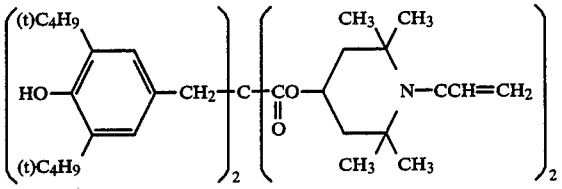
(f) Solvent
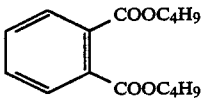
(g) Color stain preventing agent
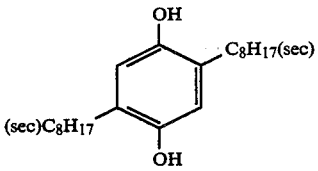
(h) Magenta coupler
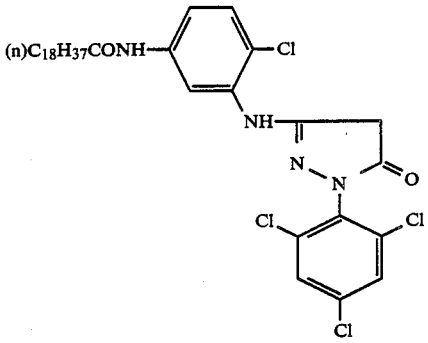
(i) Color image stabilizing
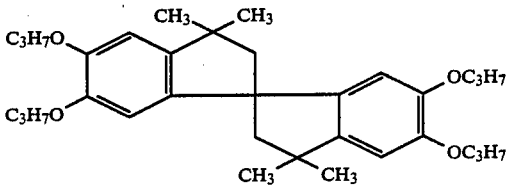
(j) Solvent
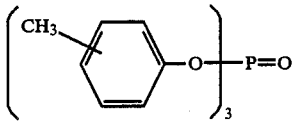
(k) UV absorber
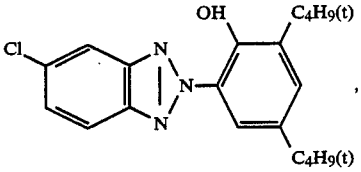
,
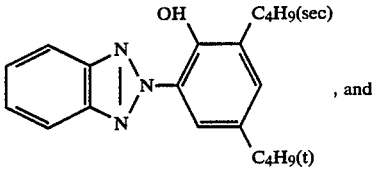
, and
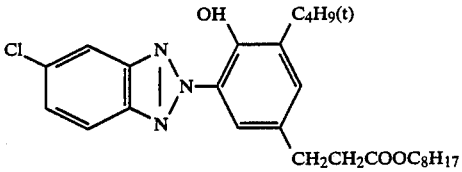
1:5:3 mixture (molar ratio)
(1) Color stain preventing agent
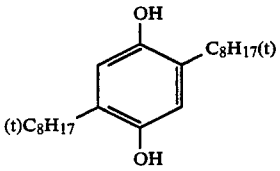
(m) Solvent
(iso $C_9H_{18}O)_3P{=}O$ (n) Cyan coupler

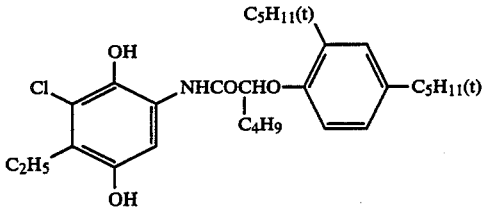

(o) Color image stabilizer

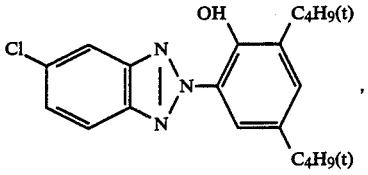

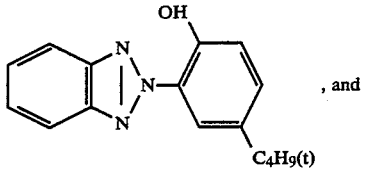

, and

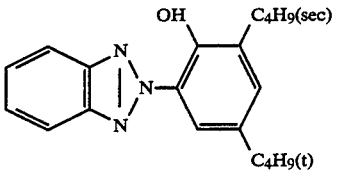

1:3:3 mixture (molar ratio)

(p) Magenta coupler

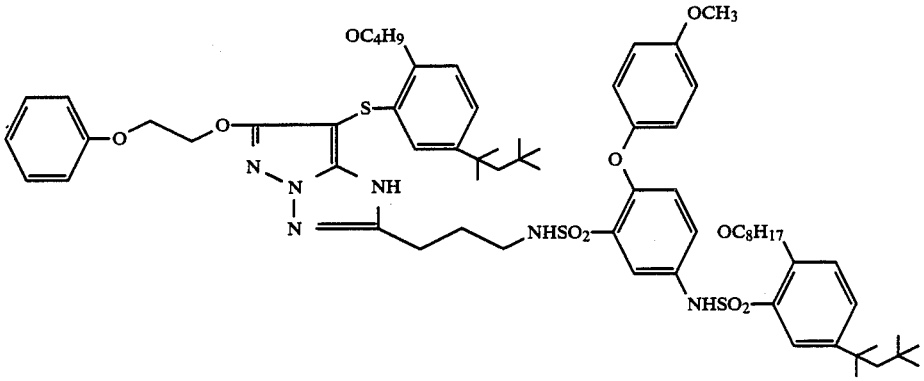

EXAMPLE 2

Aluminum was vacuum-deposited on the surface of polycarbonate sheet (170 μm thickness) under $10^{-5}$ Torr. The thickness of the vapor deposited film was about 1000 Å. The surface had the mirror reflecting properties. Then, an emulsion polymerizate was obtained by adding about 1 wt % of chrome alum based on the copolymerizable monomers employed in the polymer coating composition 3 described in Example 1. The product was coated and dried in an amount of 0.5 g/m$^2$ to produce an adhesive layer. Successively, gelatin was coated on the adhesive layer and dried to prepare a subbing layer. The thickness of the subbing layer was about 0.1 μm.

Then, a red-sensitive emulsion layer comprising a gelatin emulsion of fine particulate silver bromide grains (halogen composition: I=2 mol %, Br=98 mol %, average grain size 0.05 μm), a sensitizing dye, 4-4'-bis(4,6-dianilinotriazine-2-ylamino)stilbene-2-2'-disulfonic acid disodium salt as an super sensitizer, an irradiation preventing dye, a coating aid, and 1-hydroxy-3,5-dichlorotriazine sodium salt as a hardening agent was coated on the subbing layer and further, a gelatin layer containing 1-hydroxy-3,5-dichlorotriazine sodium salt was coated on the emulsion layer as a protective layer to obtain an optical disc recording plate.

Pulse signals at 600 nsec were applied by an acoustic-optical modulation device using He-Ne laser beams to provide signal exposure. The exposed plate was developed by using MQ type black and white developing solution having the following composition at 20° C. for 5 min and fixed, washed with water and dried. A laser disc plate of high physical strength could be obtained with no delamination. On the other hand, a similar comparative sample of the laser disc plate, which deffered only in that the chromium alum was not used, was prepared and given the same development treatment. Delamination occurred and images could not be obtained.

Composition of MQ type Black and White Developing Solution

| | |
|---|---|
| Methol | 2.0 g |
| Sodium anhydrous sulfite | 90.0 g |
| Hydroquinone | 8.0 g |
| Sodium hydrocarbonate monohydrate | 52.5 g |
| Potassium bromide | 5.0 g |
| Water to make | 1 liter |

EXAMPLE 3

A disc recording plate was obtained in the same manner as in Example 2, except for using the following compounds (1) and (2) in a mixture instead of chrome alum and also using the following compounds (1) and (3) in a mixture instead of 1-hydroxy-3,5-dichlorotriazine sodium salt in the emulsion layer and protective layer.

A laser disc plate with no delamination and excellent image sharpness was obtained in the same manner as in Example 2 by conducting exposure, development and fixation and by way of a stabilization bath.

Compound (1)

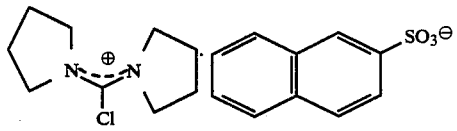

Compound (2)

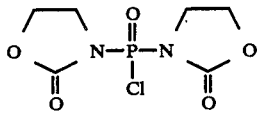

Compound (3)

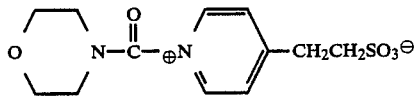

COMPARATIVE EXAMPLE 1

A photographic printing paper was obtained in the same manner as in Example 1, except for not employing the adhesive layer shown in Example 1, but directly coating gelatin as a subbing layer on to the aluminum surface.

The adhesion property was evaluated by the following test method.

ADHESION TEST METHOD (1) Adhesion test upon drying before treatment

A polyester adhesion tape (Nitto-Mylar Tape No. 31) was placed on the emulsion surface after drying the photographic emulsion and separated instantaneously.

(2) Adhesion test upon moistened state during treatment

The emulsion surface of the sample after development, fixing and water washing was scratched in a square-like manner by a stylus in a moistened state and frictionally rubbed ten times by a rubber member under the loading of 3 kg.

(3) Adhesion test upon drying after treatment

The emulsion surface of the sample after development, fixing, water washing and drying was scratched in a square-like manner by a stylus, a Nitto Mylar Tape No. 31 was placed on the scratched emulsion surface, and after leaving for 24 hours under the condition of 25° C., 55% RH, the tape was instantaneously peeled off.

The products obtained in the above examples were evaluated by the above tests (1)–(3) and given the following ratings depending on how the emulsion layer stripped: Class A-not stripped at all; Class B-stripped slightly; Class C-stripped somewhat but satisfying the lower limit of practical use; and Class D-stripped to such an extent as to cause practical problems in the use of the product.

The results of the three adhesion tests (Drying before development, Moistened state during treatment, and Drying after treatment) for the photographic color printing papers described in Example 1 and Comparative Example 1 are shown in Table 4.

TABLE 4

| Adhesion test | Sample No. 1 | 2 | 3 | 4 | 5 | 6 | Comparative Sample |
|---|---|---|---|---|---|---|---|
| Drying before treatment | A | B | A | B | A | B | D |
| Moistened state during treatment | A | C | A | C | A | C | D |
| Drying after treatment | A | B | A | B | A | B | D |

As apparent from the result of the table, it can be seen that the adhesion is improved by the adhesive layer of the copolymer composition used in the present invention and the adhesion is further improved by the addition of the hardening agent.

EXAMPLES 4 TO 9

Metal aluminum was subjected to coarse rolling. Then two metal aluminum sheets were rolled in lamination successively between two above and below adjacent rolling rollers to obtain an aluminum foil of about 10 μm thickness, which was then annealed. This aluminum foil had a secondary diffuse-reflective surface.

The silane coupling agents shown in Table 5 were coated on the surface of the soft aluminum foil of 10 μm thickness having the secondary diffuse-reflection in an amount of 0.5 g/m$^2$, dry weight, and then dried in an oven at 150° C. for 3 min.

Further, in Examples 5, 7 and 9, 50% of the alkoxy groups of the silane coupling agents were hydrolyzed to form silanol groups.

TABLE 5

| | Example 4 | Example 5 | Example 6 | Example 7 | Example 8 | Example 9 |
|---|---|---|---|---|---|---|
| Silane coupling agent | γ-methacryloxy propyltrimethoxysilane | | γ-glycidoxy propyltrimethoxysilane | | γ-glycidoxy propyltriethoxysilane | |
| Silanol group formation | No | Yes | No | Yes | No | Yes |

Butyl titanate was coated in an amount of 0.1 g/m$^2$ on the aluminum surface opposite to the adhesive layer coated with the silane coupling agent.

The surface of the aluminum foil coated with butyl titanate and a base paper of 150 g/m$^2$ basis weight were laminated by means of low density polyethylene melted at 300° C. Further, high density polyethylene then was laminated onto the base paper by melting at the surface opposite to the aluminum lamination at 250° to 350° C.

Corona discharge treatment was applied to the silane coupling agent-coated surface and gelatin was coated in an amount of 0.3 g/m$^2$, on a dry basis, and then dried at 80° C. for one min.

A silver halide emulsion was coated onto the above-mentioned support according to Example 4 of Japanese Patent Application (OPI) No. 24247/88 to obtain a printing paper for color photography.

Silver halide emulsions (1) to (4) of Example 1 of the present specification were used to prepare each printing papers of Examples 4 to 9 of the present specification. Each printing paper in Examples 4 to 9 had a first layer to seventh layer. The first layer to seventh layer of each printing paper was the same as in Example 1. Each printing paper was image exposed and subjected to color development, bleach-fixing and rinsing in the same manner as Example 1.

Upon visually observing the photographic images obtained by employing the supports of the present invention, the saturation of the magenta and yellow images were extremely excellent and the sharpness was surprisingly improved. A comparative sample produced in Comparative Example 2 described below caused delamination and an image could not be observed.

COMPARATIVE EXAMPLE 2

Print paper for color photography was obtained in the same manner as in Examples 4 to 9, except that in Comparative Example 2 the gelatin subbing layer was coated directly onto the aluminum surface without coating the silane coupling agent shown in Examples 4 to 9.

The photographic printing paper obtained in Examples 4 to 9 and Comparative Example 2 were subjected to the same adhesion tests described in Comparative Example 1 and evaluated in the same manner as in Comparative Example 1.

The results of the adhesion tests are shown in Table 6.

TABLE 6

| Adhesion test | Example 4 | 5 | 6 | 7 | 8 | 9 | Comparative Example 2 |
|---|---|---|---|---|---|---|---|
| Drying before treatment | C | B | C | A | C | A | D |
| Moistened state during treatment | C | B | C | A | C | A | D |
| Drying after treatment | C | B | C | A | C | A | D |

As apparent from the result of the Table 6, it can be seen that the adhesion of the silver halide emulsion layer was improved by using the silane coupling agent as the adhesive layer and, particularly, the effect is significant for those layers in which silanol groups were formed.

EXAMPLES 10 TO 12

Aluminum was vapor-deposited onto the surface of a polycarbonate sheet (170 μm thickness) under $10^{-5}$ Torr. The thickness of the vapor deposited film was about 1000 Å.

The surface had mirror reflection. Then, the adhesive layers in Examples 5, 7, 9 were respectively coated on mirror reflective surface in an amount of 0.5 g/m$^2$, on dry basis, and dried in an oven at 150° C. for 3 min (Examples 10, 11 and 12). Then, a corona discharging treatment was applied and gelatin was coated and dried to obtain a subbing layer. The subbing layer thickness was about 0.1 μm.

Then, the same emulsion layer and protective layer as in Example 2 were coated thereover in the same manner as in Example 2 to obtain an optical disc recording plate.

Pulse signals at 600 nsec were applied by an acoustic-optical modulation device using He-Ne laser beams to provide signal exposure. The sample was developed by using MQ type black and white developing solution as in Example 2 at 20° C. for 5 min and then fixed, washed with water and dried. A laser disc plates of high physical strength could be obtained with no delamination could obtained. On the other hand, comparative samples of laser disc plate which differed only in that no adhesive layer of the silane coupling agent, was prepared and given the same developing treatment. Delamination occurred and images could not be observed.

While the invention has been described in detail and with reference to specific embodiments thereof, it will be apparent to one skilled in the art that various changes and modifications can be made therein without departing from the spirit and scope thereof.

What is claimed is:

1. A photographic element comprising a support having provided thereon at least one light-sensitive silver halide emulsion layer, wherein said support comprises a substrate having thereon a metal film layer having a secondary diffuse-reflective surface and an adhesive layer on said metal film layer, wherein said adhesive layer consists of a silane coupling agent represented by formula (2-I) or (2-II):

$$Y-R-\overset{(CH_3)_{3-n}}{\overset{|}{Si}}R'_n \qquad \text{(2-I)}$$

$$Y-\overset{(CH_3)_{3-n}}{\overset{|}{Si}}R'_n \qquad \text{(2-II)}$$

wherein Y represents an organic functional group, R represents an alkylene group having 1 to 5 carbon atoms, R′ represents an alkoxy group having 1 to 4 carbon atoms, and n represents 2 or 3, and has a thickness of 0.01 to 5 μm.

2. A photographic element as in claim 1, wherein the metal is selected from the group consisting of silver, aluminum, gold, copper, chromium/nickel alloy, platinum and alloy thereof.

3. A photographic element as in claim 1, wherein Y of formula (2-I) and (2-II) is selected from the group consisting of a vinyl group, a methacryl group, an epoxy group, an amino group and a mercapto group.

4. A photographic element as in claim 1, wherein the silane coupling agent is selected from the group consisting of vinyltrichloro silane, vinyltris (β-methoxyethoxy)silane, vinyltriethoxy silane, vinyltrimethoxy silane, γ-methacryloxypropyltrimethoxy silane, β-(3,4-epoxycyclohexyl)ethyltrimethoxy silane, γ-glycidoxypropyltrimethoxy silane, γ-glycidoxypropylmethyldiethoxy silane, N-β(aminoethyl)γ-aminopropyltrimethoxy silane, N-β(aminoethyl)γ-aminopropyldimethoxy silane, γ-aminopropyltriethoxy silane, N-phenylγaminopropyltrimethoxy silane, γ-mercaptopropyltrimethoxysilane, γ-chloropropyltrimethoxy silane.

* * * * *